US006530122B1

(12) United States Patent
Kondou et al.

(10) Patent No.: US 6,530,122 B1
(45) Date of Patent: Mar. 11, 2003

(54) HINGE DEVICE

(75) Inventors: Jun Kondou, Yamanashi-ken (JP); Mitsumasa Ogihara, Yamanashi-ken (JP)

(73) Assignee: Nisca Kabushiki Kaisha, Yamanashi-ken (JP)

( * ) Notice: Subject to any disclaimer, the term of this patent is extended or adjusted under 35 U.S.C. 154(b) by 0 days.

(21) Appl. No.: 09/016,148

(22) Filed: Jan. 30, 1998

(30) Foreign Application Priority Data

Feb. 3, 1997 (JP) ..... 9-035522

(51) Int. Cl.[7] ..... E05E 11/10
(52) U.S. Cl. ..... 16/335; 16/257; 16/280
(58) Field of Search ..... 16/335, 257, 277, 16/280, 281, 382, 270, 384, 289

(56) References Cited

U.S. PATENT DOCUMENTS 4,457,047 A * 7/1984 Lautenschlager ..... 16/288
4,470,169 A * 9/1984 Lautenschlager et al. ..... 16/291
4,502,182 A * 3/1985 Lautenschlager et al. ..... 16/288
4,834,277 A * 5/1989 Gomoll et al. ..... 226/101
4,842,349 A * 6/1989 Stenemann ..... 312/116
5,356,095 A * 10/1994 Aker ..... 16/284
5,513,420 A * 5/1996 Kennedy ..... 16/289
5,570,498 A * 11/1996 Hipkiss et al. ..... 16/258
5,644,817 A * 7/1997 Bender et al. ..... 16/382
5,926,917 A * 7/1999 Gantz ..... 16/334
6,006,064 A * 12/1999 Hashimoto ..... 399/380

* cited by examiner

*Primary Examiner*—Anthony Knight
*Assistant Examiner*—Mark Williams
(74) *Attorney, Agent, or Firm*—Perkins Coie LLP

(57) ABSTRACT

A hinge device which can be readjusted easily by bringing a rotating member into contact with a friction member. A first fixing member 10 fixed to a copying machine 1 and a second fixing member 11 fixed to an ADF 2 are connected to each other by means of a first shaft member 13 bearing them so as to be free to rotate; the member 10 has a rotating member 7 fixed to a second shaft member 16 arranged in parallel with the shaft member 13. The member 7 is put into contact with a friction member 15 arranged on the shaft member 13 to form a frictional portion. The member 15 is always in contact with the member 7 on its surface. A hole for bearing the shaft member 16 is an oblong hole 14, with its bottom surface which allows the shaft member 16 to take rocking motions for an arbitrary adjustment of a contact pressure to the member 7. A third shaft member 18 is arranged as a shaft at the other end of the member 11 apart from the portion where the shaft member 13 is arranged, with a spring put between the shaft member 18 and the shaft member 16.

10 Claims, 8 Drawing Sheets

HINGE DEVICE

BACKGROUND OF THE INVENTION

1. Field of the Invention

The present invention relates to a hinge device for coupling a unit such as a document press unit or a document feeder used for an image forming apparatus such as a copying machine, an image scanner, or a printer to an image processing unit so that the unit can be freely opened or closed, and more particularly to a hinge device which performs readjustment of a vertical load of the unit by means of friction.

2. Related Background Art

Conventionally, there is a unit for screening light streaming paths to an image forming apparatus and for conveying a document with applying an appropriate pressure to the document against a platen. If the unit is coupled to the image forming apparatus such as a copying machine so that it can be opened or closed freely, a hinge device is used to couple a side of the image forming apparatus in a document conveying direction to an opposite side of the unit for the open-close action.

This hinge device has a first fixing member fixed to the image forming apparatus and a second fixing member fixed to the unit being connected to each other by means of a rotating shaft so as to be free to take rotational movements, with an expansible cushioning member such as a spring or a hydraulic cylinder put between the first and second fixing members, so as to reduce or adjust a weight for opening or closing the unit by means of the cushioning member.

In conventional hinge devices, from the viewpoint of a fixing relationship between the first and second fixing members and the cushioning member, there are known two types of hinge devices; one is a hinge device (a) having a cushioning member whose both ends are supported by the first and second fixing members so as to be free to take rotational movements and the other is a hinge device (b) having a configuration in which a spring action of a cushioning member is used to apply a contact pressure to one end of a cam surface arranged on one of the first and second fixing members for opening or closing the fixing members so as to be along the cam surface.

Although the hinge device (a) has a simple configuration in which the opening or closing action is controlled only by force of a spring or a hydraulic cylinder, its operating force of the open-close action cannot be arbitrarily set. On the other hand, although the hinge device (b) allows its operating force of the open-close action to be set as designed since the open-close action is controlled by the cam surface in addition to the force of the spring, it has a complicated configuration. In addition, in both types of the conventional hinge devices (a) and (b), in some cases, there occurs unevenness of a weight for opening or closing on the unit to be opened or closed, or a sudden or slow open-close action occurs if an uneven force is required for the operation according to an open-close position, which leads to a dangerous condition or by which an appropriate pressure cannot be applied to a platen. To cope with this problem, a friction member is arranged for a readjustment of a vertical load at opening or closing separately from the cushioning member, so as to prevent such a sudden action.

As a configuration of the friction member for this readjustment, a cylinder member and a piston member are installed with engaging with one and the other of the fixing members, so as to be used to readjust the open-close action or to relieve an interlocking action by means of a frictional resistance of sliding when the cylinder member and the piston member are sliding together with the open-close action of the unit. This configuration, however, has a disadvantage that an initial frictional force cannot be applied due to wearing of the cylinder member and the piston member caused by use or a temperature change during use.

SUMMARY OF THE INVENTION

Principally it is an object of the present invention to provide a hinge device which allows a smooth open-close action by damping an action of a cushioning member at the open-close action in a simple configuration, and it is another object of the present invention to provide a hinge device which allows its controlling force to be increased or decreased according to an open-close angle.

To achieve these objects, there is provided a hinge device according to the present invention comprising first and second fixing members connected to each other by means of a rotating shaft so that they can take relative rotational movements and a cushioning member which is expandable and rocking in response to the rotational movements of the fixing members with one end supported by the first fixing member and the other end supported by the second fixing member, wherein there are provided a rotating member which is connected to at least one end of the above cushioning member so as to rock or rotate in response to the rocking motion of the cushioning member and a friction member which is put into contact with the rocking member or the rotating member so as to damp the rocking motion of the cushioning member.

DETAILED DESCRIPTION OF THE PREFERRED EMBODIMENTS

Figure 1:
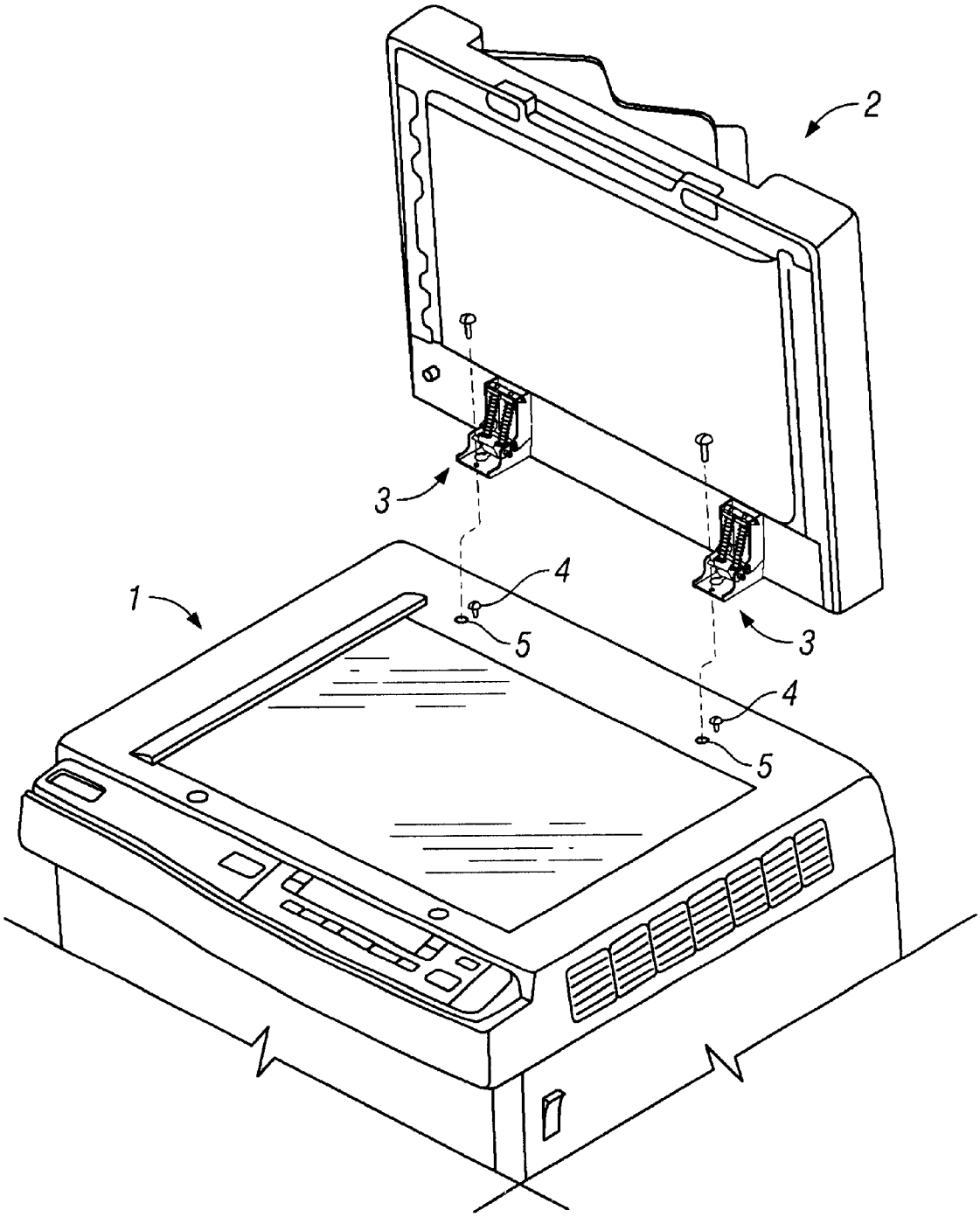
FIG. 1 is a view illustrating an engaging relationship between an image forming apparatus and a unit according to the present invention.

Referring to FIG. 1, there is shown an engaging relationship between an image forming apparatus and a unit according to the present invention.

In FIG. 1, the unit, for example, an ADF (an automatic document feeder) 2 is fixed to the image forming apparatus, for example, a copying machine 1 via a pair of right- and left-hand hinge devices 3 so as to be free to open or close. The ADF 2 can be a unit which serves as only a cover of a document without a document feeding mechanism.

To fix the hinge device 3 to the copying machine 1, a stepped hook 4 and a threaded hole 5 are arranged in one side of the copying machine in the document conveying direction so as to be fixed to a first fixing member of the hinge device 3. In addition, with a screw or the like, the ADF 2 is fixed to a second fixing member of the hinge device 3, by which the ADF 2 can be opened or closed to the copying machine via the hinge device.

The hinge device 3 of the present invention can be applied to one having a lift function, in other words, which can follow a thickness of a document.

Figure 2:
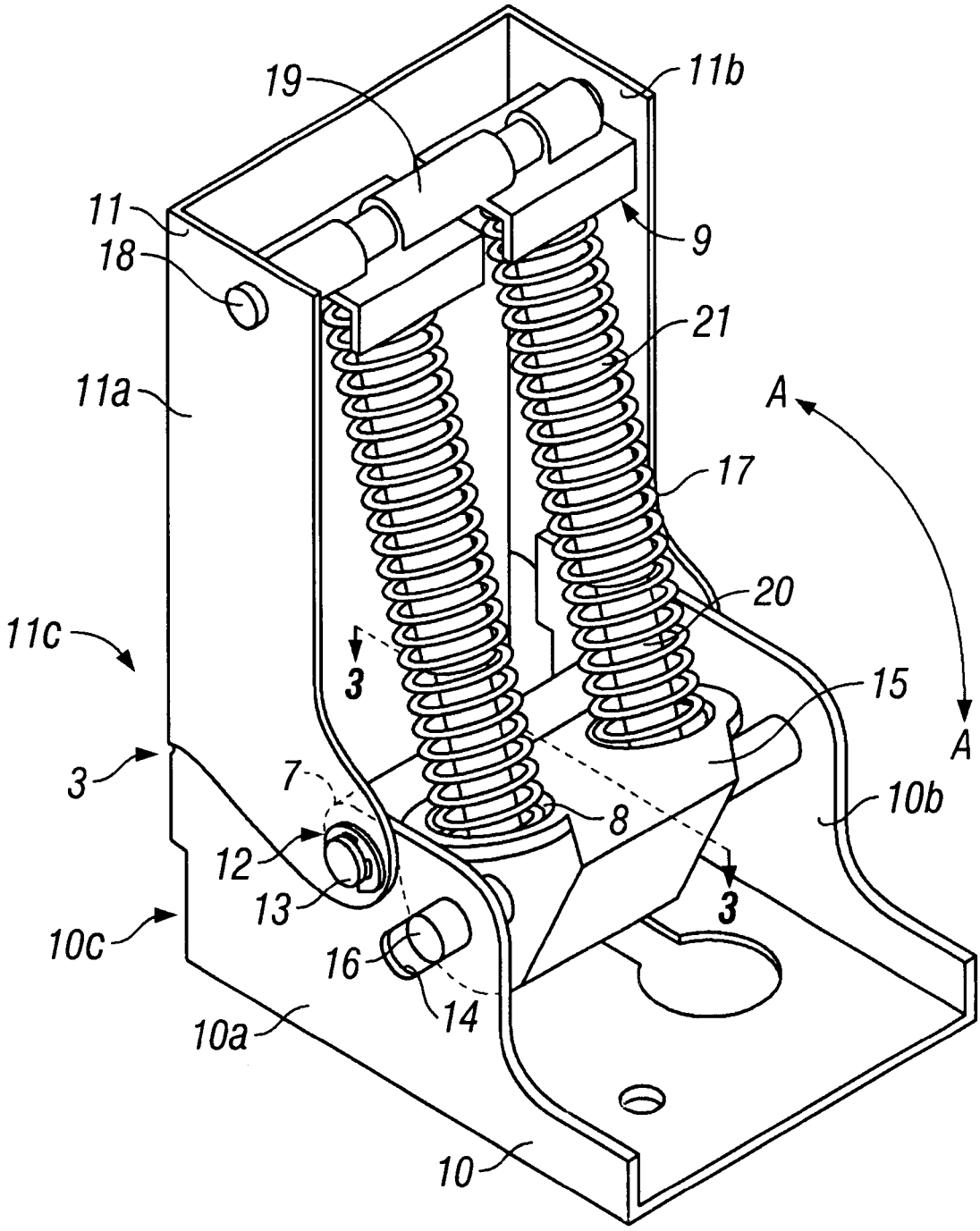
FIG. 2 is a perspective view illustrating basic configuration requirements of a hinge device 3 according to the present invention.

Referring to FIG. 2, there is shown a perspective view illustrating basic configuration requirements of the hinge device 3 of the present invention.

In FIG. 2, the hinge device 3 comprises a first fixing member 10 made of a metal plate to be fixed to the copying machine 1 and a second fixing member 11 made of a metal plate to be fixed to the ADF 2, with the metal plates which form the first and second fixing members 10 and 11 each having almost U-shaped curves so as to have side portions 10*a* and 10*b* or side portions 11*a* and 11*b*. Further in this configuration, the U-shaped portions of the first fixing member 10 can be engaged with the U-shaped portions of the second fixing member 11 inside so as to be opposite to each other, and a hole 12 is made on each of the side portions 10*a* and 10*b* and the side portions 11*a* and 11*b* of the first and second fixing members 10 and 11 so as to be faced with each other, so that a pin member described later to pass through the side portions and a shaft member to be a friction member 7 or the shaft member itself are inserted into the holes for bearing as a first shaft member 13. By using this first shaft member 13 as a supporting shaft, the first and second fixing members 10 and 11 are connected to each other so as to be free to take rotational movements in A—A direction indicated by arrows.

Slits or slender holes 14 (represented by oblong holes in FIG. 2) are arranged on the side portions 10*a* and 10*b* of the first fixing member 10 apart from the position of the first shaft member 13 in a direction described later so as to be opposite to each other, and there is supported a second shaft member 16 to which a rocking member 15 (hereinafter, a rotating member) is fixed in the oblong holes 14. The rotating member 15 comprises a rotator which rotates around a bearing support of the spring 17.

The rotating member 15, which is made of resin having high lubricity, are arranged so as to be in contact with the friction member 7 or with the first shaft member 13 as the friction member 7, forming a frictional portion where friction is generated on its contact surface. As the frictional portion, it is possible to use a circular circumferential portion of the second shaft member 16, and further it is also possible to apply a non-circular cam to the rotating member 15 in a direction of the frictional portion. In this case, the same operation and effects are obtained from a configuration in which the rotating member 15 has a circular shape and a non-circular cam is applied to the contact surface on the second shaft member 16 used as the friction member 7. In addition, there is arranged a mounting seat 8 for holding an end of at least one of the springs 17 used as cushioning members on a surface of the rotating member 15 in a direction of a third shaft member, by which the springs 17 are connected to the rotating member 15 integrally.

A third shaft member 18 is supported at the other end of the side portions 11*a* and 11*b* of the second fixing member 11 apart from the portion to which the first shaft member 13 is fixed, with a holding member 19 for holding the other end of at least one of the springs 17 being arranged thereon. On the holding member 19, there is arranged a mounting seat 9 for holding the other end of the spring 17, and the spring 17 is put between the mounting seat 8 of the rotating member 15 and the mounting seat 9 of the holding member 19 so as to spring in a direction of opening the hinge device. In addition, to have a fixed spring direction of the spring 17, there is arranged a guide insert member 20 which can be fit with a play in the cylindrical guide member 21 between the rotating member 15 and the holding member 19. As a result, the spring 17 is expanded or contracted and takes a rocking motion in response to opening or closing of the hinge device 3.

In FIG. 2, the first and second fixing members 10 and 11 take rotational actions around the first shaft member 13, and to restrict the maximum release position of the ADF 2 to the copying machine 1, a rear portion 10*c* of the first fixing member 10 is bent so as to be put into contact with a rear portion 11*c* of the second fixing member 11 at the maximum release position. Therefore, the copying machine 1 and the ADF 2 can be released to the maximum at this contact position. There may be arranged a maximum release position setting means for setting arbitrarily the maximum release position, for example, by attaching to the rear portion 10*c* a stopper means which can adjust the contact position with the rear portion 11*c*.

Figure 3A:
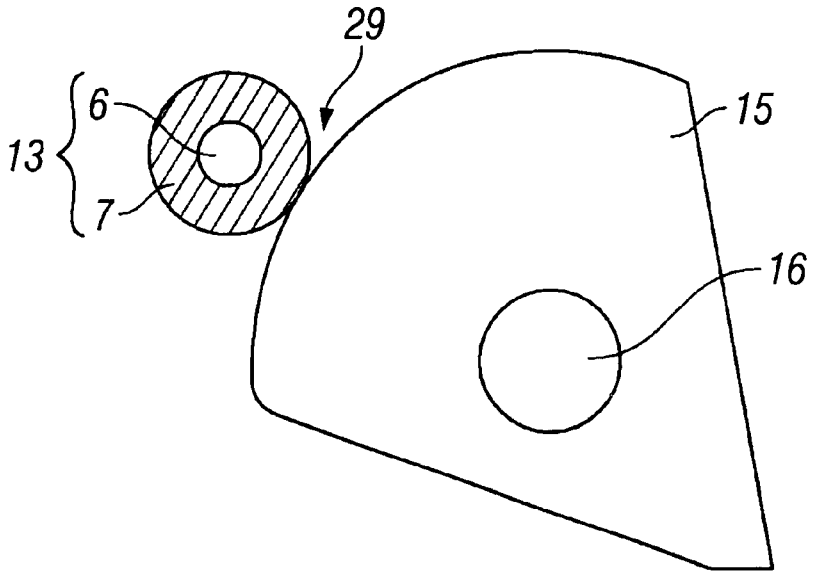
FIG. 3 is a sectional view of a main portion taken on line B—B indicated by arrows in FIG. 2, illustrating a configuration of members composing a frictional portion.
Figure 3B:
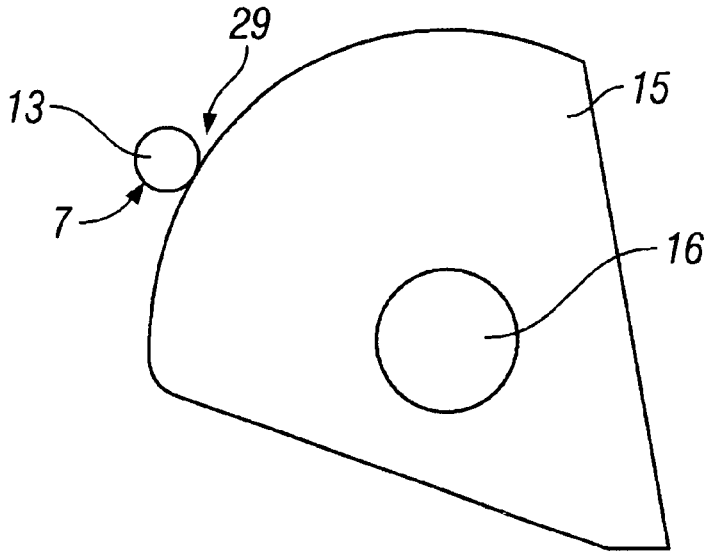

Referring to FIG. 3, there is shown a sectional view of the main portion taken on line B—B with arrows shown in FIG. 2, which is a diagram illustrating a configuration of members composing a frictional portion 29; FIG. 3(*a*) shows the portion in which the first shaft member 13 is made of the pin member 6 coated with the frictional portion 7 and FIG. 3(*b*) shows a shaft member used as the first shaft member 13.

In FIG. 3, the rotating member 15 fixed to the second shaft member 16 is rounded in a direction of the first shaft member 13, having the frictional portion between itself and the friction member 7 which is in contact with it. As shown in FIG. 3(*a*), as the first shaft member 13 in contact with the rotating member 15, is used the pin member 6 to be the shaft member coated with the friction member 7, or as shown in FIG. 3(*b*), a surface itself of a cylinder of the first shaft member 13 is used as the friction member 7. In either case, the friction member 7 is put in contact with the rotating member 15, forming the frictional portion.29 which generates friction on the contact surface.

Figure 4A:
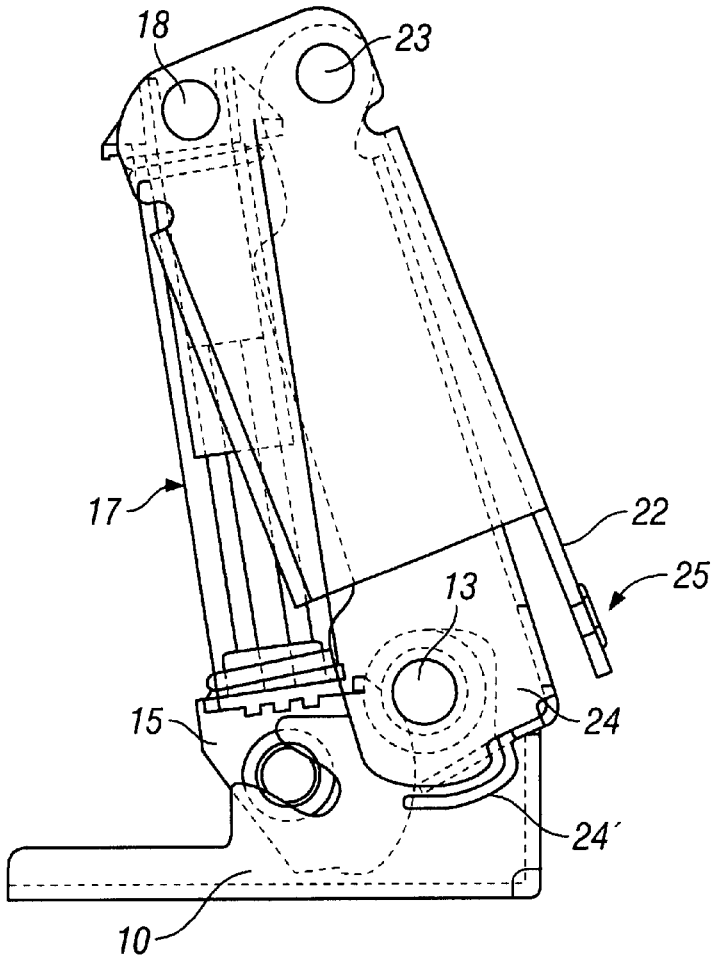
FIG. 4 is a configuration diagram illustrating a mechanism for adjusting the contact state of ADF with the platen glass of a copying machine when ADF is closed, in addition to the basic configuration requirements of the present invention.
Figure 4B:
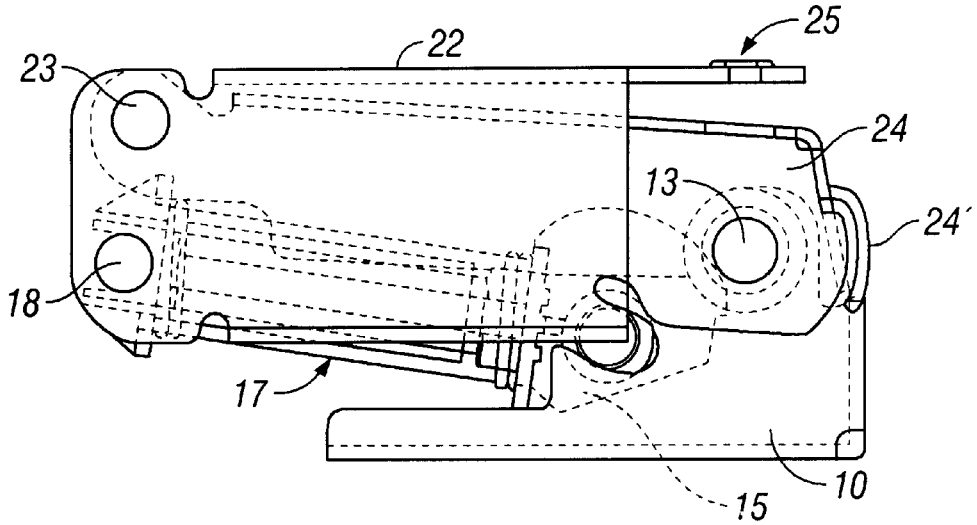

Referring to FIG. 4, there is shown a configuration diagram in which there is provided a mechanism for adjusting the contact state of the ADF 2 with the platen glass of the copying machine 1 when ADF 2 is closed, in addition to the basic configuration requirements shown in FIG. 2; FIG. 4(*a*) shows a side view at the maximum release position and FIG. 4(*b*) shows a side view at the minimum close position. Furthermore, referring to FIG. 5, there is shown a top plan view related to FIG. 4.

Figure 5:
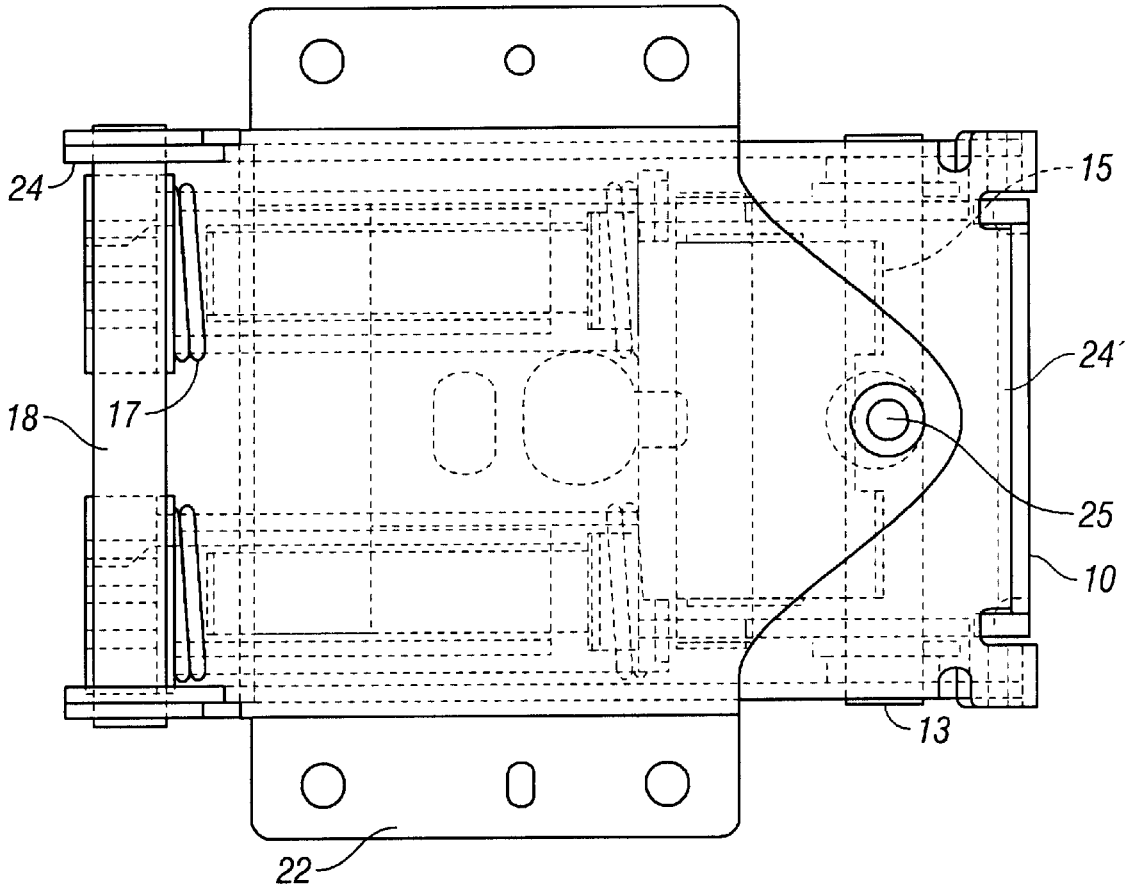
FIG. 5 is a top plan view related to FIG. 4.

In FIGS. 4 and 5, the second fixing member has a third fixing member 22 made of a metal plate fixed to the ADF 2 which differs from the second fixing member 11, the spring 17 is put between the third shaft member 18 and the rotating member 15, a fourth shaft member 23 is supported by a member 24 corresponding to the second fixing member 11 shown in FIG. 2, and the member 24 is connected to the first fixing member 10 via the first shaft member 13 so as to rotate around the shaft member 13. In addition, there is arranged a safetyguard member 24' on the inner side of the member 24 near the first shaft member 13. The safetyguard member 24' is crooked with a slight projection, being arranged along the rotation of the shaft member 13. Therefore, in the range of the rotational action of the member 24, there is no space between the member 24 and the fixing member 10 in the inner side portion. In other words, it becomes possible to prevent a finger or the like from being caught in the device due to this configuration.

In the adjusting mechanism 25 shown in FIGS. 4 and 5, the space between the third fixing member 22 and the first shaft member 13 can be adjusted by inserting a machine screw 25B so as to contact with the first shaft member 13 through a tapped hole 25 and by fixing the machine screw 25B to the fixing member 22 with a nut 25*c*. This adjusting mechanism makes it possible to adjust the contact state such as the side contact of the platen glass of the copying machine 1 with ADF 2 when ADF 2 is closed.

Figure 6:
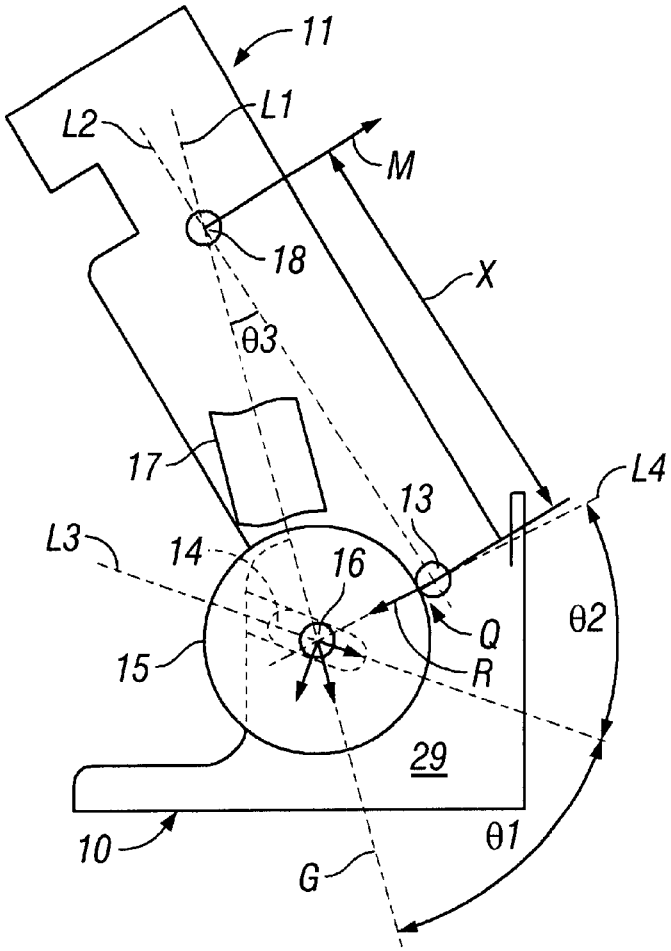
FIG. 6 is a view illustrating a relationship on an opening or closing force between a first fixing member and a second fixing member or a relationship between a shaft direction of the oblong hole and a drag of the frictional portion.

Referring to FIG. 6, there is shown a diagram used for an explanation of a relationship on an opening or closing force between the first fixing member 10 and the second fixing member 11 or a relationship between a shaft direction of the oblong hole 14 and a drag of the frictional portion 29.

In FIG. 6, there is provided an angle θ3 made by an axis L1 of the spring 17 and an axis L2 from the center of the third shaft member 18 to the center of the first shaft member 13 as a relationship between the first fixing member 10 and the second fixing member 11, by which a component force is generated in the spring force of the spring 17 and a moment M occurs in the opening direction.

If G is a spring force of the spring, the relationship can be stated as follows:

$$M=x(G \sin \theta 3)$$

where x is a length between the center of the third shaft member 18 and the center of the first shaft member 13, and θ3 is an angle determined by a position where the second shaft member 16 is located to the first shaft member 13 and the third shaft member 18, whereby the angle depends on a degree of opening or closing of the hinge device and therefore it varies according to the position where the third shaft member 18 is located relative to the second shaft member 16 and the first shaft member 13. Accordingly, M is located at a desired position as a design condition.

In addition, the spring force G of the spring 17 can be represented with being divided relative to a direction of an axis L3 of the oblong hole 14. In this case, the first shaft member 13 is in contact with the rotating member 15 at the frictional portion 29, and therefore they are stated as follows:

$$G \cdot \cos \theta 1 = R \cdot \cos \theta 2$$

where R is a drag from the shaft member 13 at a contact point Q of the frictional portion 29.

If T is a frictional torque between the rotating member 15 and the friction member 7 generated at the contact point Q, the relationship is stated as follows:

$$T=r(\mu G \cos \theta 1/\cos \theta 2)$$

where r is a radius of the rotating member, and $\mu$ is a ratio of friction. Therefore, if r is varied together with the open-close angle of the hinge device, the frictional torque can be varied with the open-close angle of the hinge device. Accordingly, the rotating member 15 in the friction direction can be formed by a non-circular cam.

It should be noted that, however, an angle θ2 is already fixed at the time of designing when an opening degree of the hinge is not determined. Even if there is provided an incorporated mechanism for making the angle θ2 variable, it becomes variable only at an adjustment.

Accordingly, the frictional torque T can be adjusted in a degree of its occurrence according to the direction of the axis L3. In this meaning, the oblong hole 14 can be a slit instead of a hole if the direction of the axis L3 is fixed. Within a range that an angle θ1 is not negative, the second shaft member 16 acts to try to move in a direction that it always presses the inside of the oblong hole 14 downward as shown in the drawing, whereby it can be supported at the bottom of the oblong hole 14. In other words, there is only a condition for the receiving portion that it has a shape which is effective to keep a force balance around the shaft member 16, and therefore the oblong hole 14 is not limited to a specific shape only if such conditions are held as the direction of the axis L3 and the strength of the oblong hole 14 at its bottom.

Figure 7:
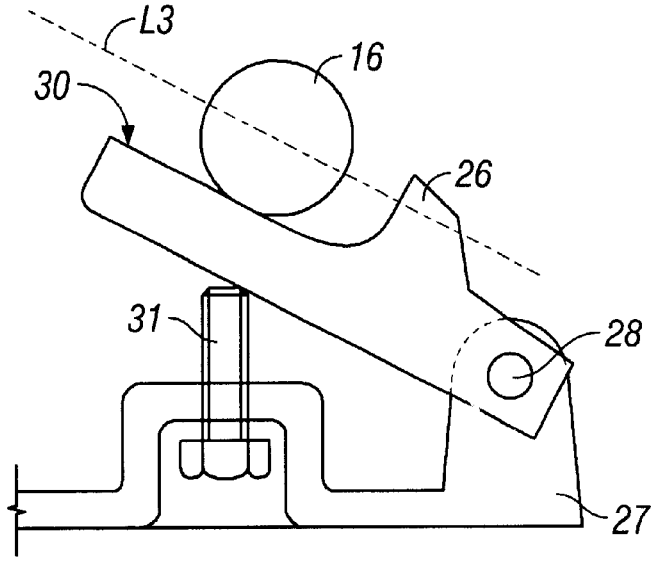
FIG. 7 is a view of an example having a mechanism for holding a second shaft member on a push stand and for adjusting an axis direction of a push stand instead of the oblong hole as shown in FIG. 2.

Referring to FIG. 7, there is shown a diagram of an example of a configuration in which the angle θ1 is caused to be variable by arranging a mechanism for holding the second shaft member 16 on a push stand 26 and for adjusting the axis direction of the push stand 26 by the above reason instead of the oblong hole 14 as shown in FIG. 2.

In FIG. 7, the second shaft member 16 is held by the bottom surface 30 of the push stand 26 which is connected to a bracket 27 extending from the first fixing member which is not shown with being supported around a fifth shaft 28. The push stand 26 can be adjusted in its direction by means of a bolt 31. An axis L3 passing through the center of the second shaft member 16 is arranged in parallel with the bottom surface 30, and the second shaft member 16 is in contact with the bottom surface 30 for pressing.

As a result, a direction of the push stand 26, in other words, a direction of the axis L3 is changed by adjusting the bolt 31, whereby it is possible to change the angle θ1 shown in FIG. 6, and therefore the frictional torque T can be arbitrarily varied.

Figure 8:
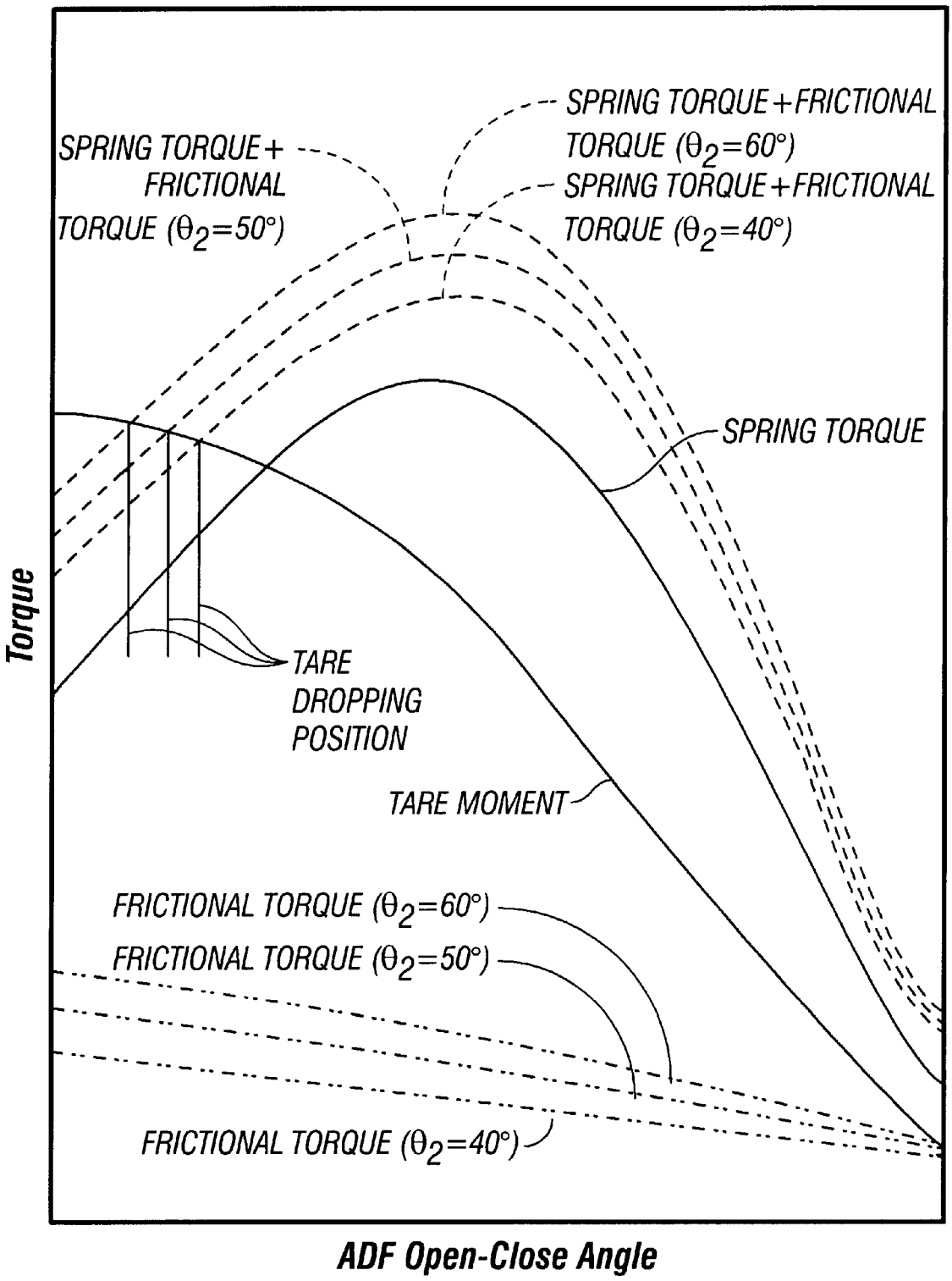
FIG. 8 is a graph showing states that the frictional portion affects a closing torque of the ADF to an open-close angle of the ADF.

Referring to FIG. 8, there is shown a graph showing states that the frictional portion affects a closing torque of the ADF to the open-close angle of the ADF.

In FIG. 8, an abscissa axis indicates the open-close angle of the ADF and an ordinate axis indicates the closing torque of the ADF.

A tare moment of the ADF is decreased with a curve as the open-close angle of the ADF increases, while the spring torque increases up to a certain degree of an angle with a curve as the open-close angle of the ADF increases and then decreases with a curve as the open-close angle of the ADF further increases afterward.

Figure 9:
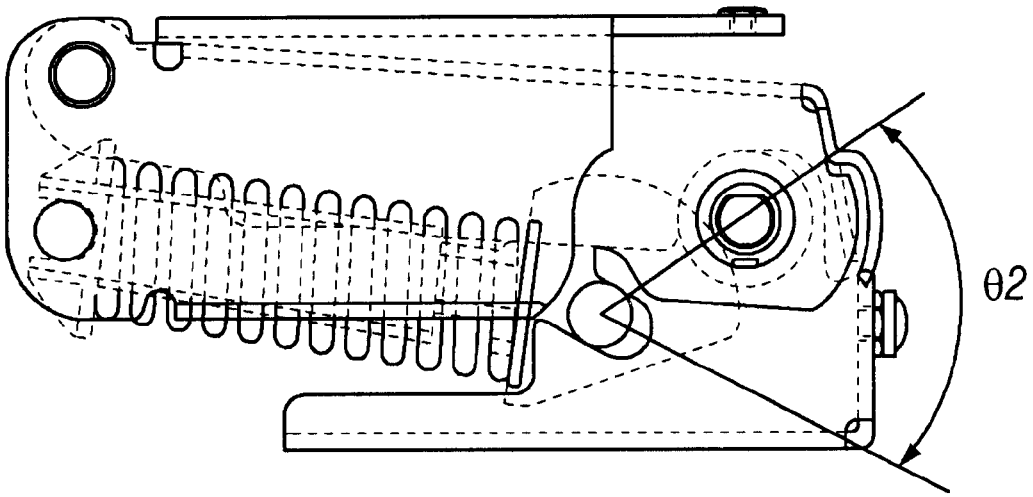
FIG. 9 is a view illustrating the axis direction of the oblong hole of the hinge device and an included angle θ2 of a first shaft member.

On the other hand, the frictional torque generated by a contact between the frictional portion of the rotating member 15 and the second shaft member 16 varies according to the angle θ2 shown in FIG. 9, acting in a direction of increasing the spring torque. As a result, a tare dropping position of the ADF can be varied to the open-close angle of the ADF. In other words, in this configuration, the opening or closing force of the hinge device is readjusted by a frictional resistance generated by a contact pressure between the frictional portion and the second shaft member 16.

As set forth hereinabove, as a configuration of a friction member for readjustment, the hinge device of the present invention comprises first and second fixing members connected to each other by means of a rotating shaft so that they can take relative rotational movements, a rotating member which rotates in response to a rocking motion of a cushioning member with being connected to at least one end of the cushioning member of the hinge device having the cushioning member which is expandable and free to take a rocking motion in response to a rocking motion of the fixing members, and a frictional portion for damping a rocking motion of the cushioning member by being put into contact with the rotating member, and therefore it is possible to dissolve a disadvantage that an initial frictional force cannot be obtained due to a wear of the cylinder member and the piston portion caused by use or a temperature change during use. Accordingly, this hinge device can be used stably for a long period of time.

Therefore, it is possible to obtain smooth open-close actions by damping interlocking actions of the cushioning member at open-close actions in a simple configuration and to increase or decrease a controlling force between the rotating member and the frictional portion for damping the rocking motion of the cushioning member by being put into contact with the rotating member according to the open-close angle. Accordingly, an optimum hinge device can be achieved with being adapted to a rotational torque of the unit so that it is easy to use.

The unit having the above configuration includes a small number of components and can operate stably for a long period, and therefore it is possible to run the unit with being free of maintenance. Furthermore, the entire unit can be configured so as to be compact, by which it becomes easy to check or repair it in maintenance and management after installation.

What is claimed is:

1. A hinge device having a first and a second fixing member connected to each other by means of a first rotating shaft so that said first and second fixing members can take rotational movements;

a cushioning member which is expandable in response to the rotational movements of the fixing members with one end of the cushioning member supported by said first fixing member and the other end of the cushioning member supported by said second fixing member;

a rocking member which is connected to at least one end of said cushioning member so as to rock in response to an expansion of said cushioning member;

a friction member for dampening rotational movements between said first fixing member and said second fixing member, being in contact with said rocking member so as to dampen the rocking members motion by friction;

a third fixing member connected to said second fixing member by means of a second rotating shaft; and an adjusting device mechanically affixed to said third fixing member located opposite to said second rotating shaft and positioned to contact said first rotating shaft so as to provide an adjustment to the dampening effect of said friction member.

2. A hinge device according to claim 1, wherein said rocking member comprises a rotator which rotates around a bearing support of said cushioning member.

3. A hinge device according to claim 1, wherein one end of said cushioning member is connected to said rocking member integrally and said rocking member is supported by one of said fixing members so that said friction member supports at least a part of a force applied in a direction of a thrust which acts to said cushioning member.

4. A hinge device according to claim 3, wherein said rocking member is supported by a bearing of said fixing member so as to be free to rotate.

5. A hinge device according to claim 3, wherein said rocking member is supported by said fixing member by means of a bearing fit with a play so as to be free to rotate.

6. A hinge device according to claim 1, wherein at least one of said rocking member and said friction member comprises a non-circular rotational cam.

7. A hinge device according to claim 1, wherein said cushioning member comprises a coil spring.

8. A hinge device according to claim 1, wherein said cushioning member comprises a mounting seat for being supported by said first fixing member, a mounting seat for being supported by said second fixing member, and a plurality of springs arranged between the mounting seats.

9. A hinge device according to claim 1, wherein at least one of said first and second fixing members comprises a bracket having a U-shaped cross section and said rocking member and said friction member are supported by a pin member in the bracket.

10. A hinge device according to claim 1, wherein one of said first and second fixing members comprises two plate members connected to each other so as to be free to rotate.

* * * * *